United States Patent [19]

Thoeny

[11] Patent Number: 4,683,696

[45] Date of Patent: Aug. 4, 1987

[54] INSULATED BUILDING STRUCTURE

[76] Inventor: Theodore T. Thoeny, 1054 Haviland Terr., Seaside, Calif. 93955

[21] Appl. No.: 737,091

[22] Filed: May 23, 1985

Related U.S. Application Data

[62] Division of Ser. No. 523,887, Aug. 17, 1983, Pat. No. 4,550,544.

[51] Int. Cl.[4] ..... E04B 1/32

[52] U.S. Cl. ..... 52/247; 52/2; 52/249

[58] Field of Search ..... 52/2 F, 393, 247, 249, 52/2

[56] References Cited

U.S. PATENT DOCUMENTS

| | | | |
|---|---|---|---|
| 2,308,248 | 1/1943 | Rehn | 52/809 X |
| 2,635,302 | 4/1953 | Denning | 52/2 X |
| 3,050,208 | 8/1962 | Irvine | 52/249 X |
| 3,574,984 | 4/1971 | Chap | 52/293 X |
| 4,069,642 | 1/1978 | Hendriks | 52/247 X |
| 4,365,455 | 12/1982 | Braine | 52/741 |

FOREIGN PATENT DOCUMENTS

| | | | |
|---|---|---|---|
| 953340 | 11/1956 | Fed. Rep. of Germany | 52/249 |

*Primary Examiner*—Carl D. Friedman
*Attorney, Agent, or Firm*—Leonard Bloom

[57] ABSTRACT

A system for forming structures, such as buildings, including the forming of a foundation slab, attaching flexible wall panels to the periphery of the foundation in a serial overlap configuration, installing prefabricated windows and doors, draping and attaching a membrane over the top of the wall panels, inflating the membrane upwardly to form a surface upon which to spray a foam substance, and spraying the foam to either the interior or exterior surfaces of the structure, including the roof membrane, so that an economical and energy efficient building can be provided at a low cost.

6 Claims, 6 Drawing Figures

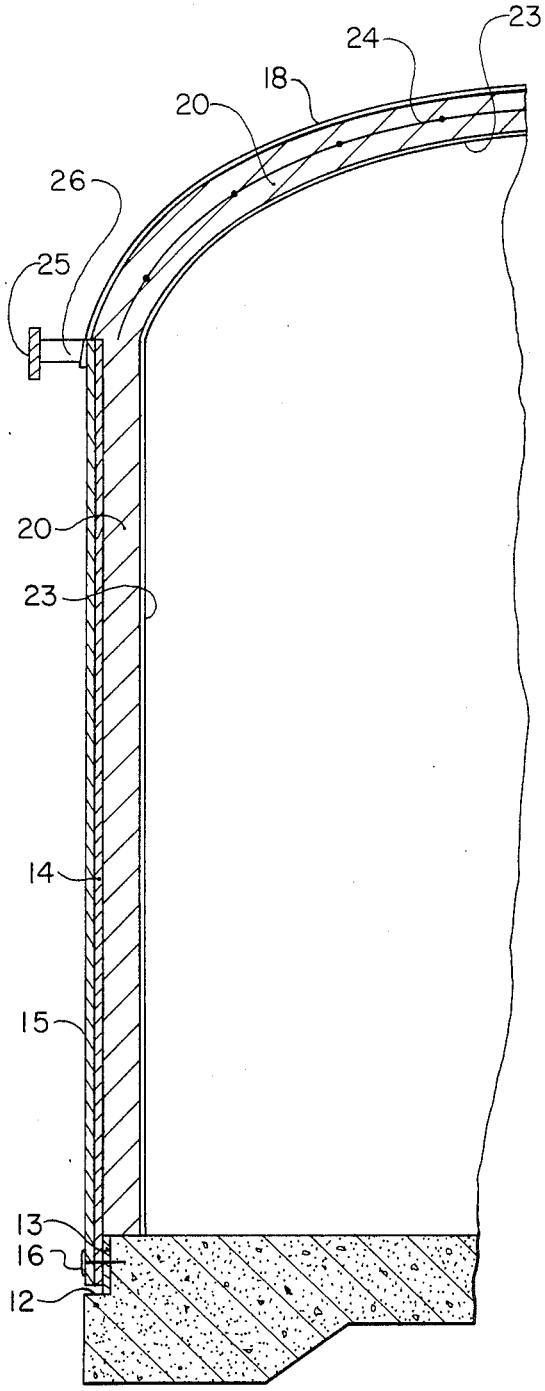
FIG 3
FIG 4
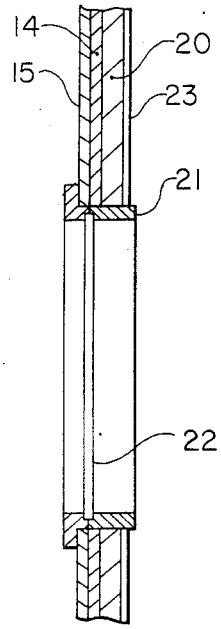
FIG 5
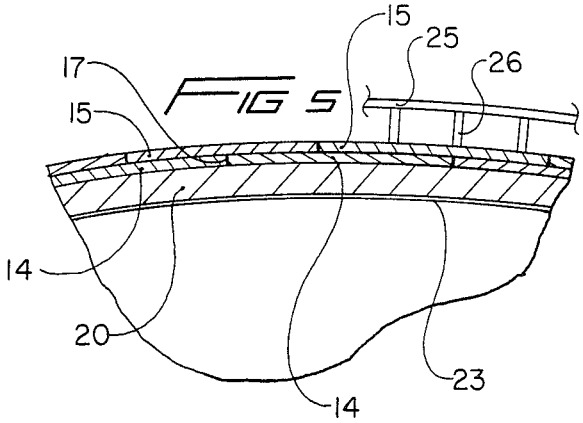
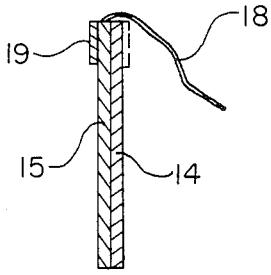
FIG 6

INSULATED BUILDING STRUCTURE

CROSS REFERENCE TO RELATED APPLICATION

The present application is a division of application Ser. No. 523,887 filed Aug. 17, 1983, entitled "Method For Forming Structures", and issued on Nov. 5, 1985 as U.S. Pat. No. 4,550,544.

BACKGROUND OF THE INVENTION

The instant application relates generally to a method for forming structures and more specifically to a method for constructing a building which may be used as a dwelling.

Due to the rising cost in producing adequate housing, there has been a dramatic increase in the methods and materials used for constructing good looking and economical dwelling structures. The costs of materials and labor of a custom built home have put the price of such a home beyond the reach of those of normal means. Therefore, a plethora of pre-fabricated building structures and structures constructed from kits have been proffered to the consumer claiming to fill the need for low cost, economical, yet attractive dwelling structures. However, prior art devices along these lines are replete with problems and inadequacies. For example, many prior art devices will not meet building or fire codes and exhibit other problems associated with appearance, energy efficiency, and structural integrity. Furthermore, many of the pre-fabricated or kit-type structures are not amenable to erection on a difficult or remote site which may be chosen as the location for a second or vacation home in the mountains, at the beach or anywhere else that presents unique site requirements.

Prior art devices require extensive structural members to be erected and fastened together to create a structural framework to which walls and roofs are attached. This increases the time, labor and materials involved in erecting the structure. These problems are greatly alleviated or eliminated by the structure according to applicant's disclosure which provides a unique way of forming walls and roofs wherein the forming process provides the structural integrity needed to support the entire structure. Therefore, there is a strong felt yet unfulfilled need for the building method according to applicant's disclosure which provides a low cost, energy efficient, and attractive method for forming economical building structures.

The following citations represent the prior art of which applicant is aware that would appear to be germane to the patent process:

U.S. Pat. No. 3,324,611, Gamber
U.S. Pat. No. 3,643,393, Pierce, et al.
U.S. Pat. No. 3,815,301, Beard, et al.
U.S. Pat. No. 3,973,367, Johnsen, et al.
U.S. Pat. No. 4,241,555, Dickens, et al.
U.S. Pat. No. 4,265,961, Bena The patent to Dickens et al. is of interest since he teaches the use of a composite panel structure and an associated method of manufacturing in which the building panel has an expanded plastic core which is first molded and then removed from the mold so as to allow reinforcing strips to be placed on the front and back surfaces thereof. The instant application is easily distinguished in that the structure according to the disclosure is itself molded over a form created from wall panels and an inflated or supported membrane so that the forming and molding process also provides the structural shell which supports the structure. The panels formed according to Dickens are prefabricated and then assembled, which is not the case in the instant disclosure.

The remaining references show the state of the art further. For example, Beard et al. teaches the use of applying polyurethane on a roof to form the roof and seal it into a single unit. Thus a supporting surface is provided upon which the polyurethane is to be sprayed.

OBJECTS AND SUMMARY OF THE INVENTION

Accordingly, it is a primary object of the present invention to provide a novel method and apparatus for forming structures which are economical, energy efficient, easily constructed on any site, and utilize modern techniques and materials.

It is a more particular object of the present invention to provide a novel method for forming structures which greatly reduces the numbers and size of structural members employed, thereby reducing the cost of labor and materials utilized in construction.

It is another object of the present invention to provide a novel method and apparatus for forming structures which can be erected in a minimal amount of time due to the efficiency of the techniques performed.

It is a still further object of the present invention to provide a novel method and apparatus for forming structures which utilizes a membrane supported in any desired configuration upon which a foam material is sprayed to form the roof of a structure.

It is still another object of the present invention to provide a novel method and apparatus for forming structures which utilizes air pressure to inflate a membrane of any desired shape upon which a foam material is sprayed to form the roof of a structure, thereby eliminating the need to erect structural members upon which a roof is built.

It is a further object of the present invention to provide a novel method and apparatus for forming structures in which the configuration of the roof portion is predetermined by adjusting the draping of the membrane upon which the foam is sprayed, thereafter using air pressure to inflate the membrane to the convex protrubance which represents the form upon which the roof is fashioned.

It is yet another object of the present invention to provide a novel method and apparatus for forming a structure which can be used to form structures of various size, shape, and configuration according to the desires of the builder. Thus structures of conventional configurations can be erected using the method of the instant disclosure.

It is a still further object of the present invention to provide a novel method and apparatus for forming structures in which a finished structure formed thusly may be easily expanded by simply cutting through a foam wall and casting a further foundation upon which wall forms are erected with a membrane draped across the top thereof, the membrane being inflated before the entire sturcture is sprayed with a foam substance.

These and other objects and features of the instant invention will become apparent when viewed in light of the following description taken in conjunction with the appended drawing figures.

BRIEF DESCRIPTION OF THE DRAWINGS

FIG. 3 is a sectional view of that which is shown in FIG. 2 taken along lines 3—3.

FIG. 4 is a sectional view of that which is shown in FIG. 2 taken along lines 4—4.

FIG. 5 is a sectional view of that which is shown in FIG. 2 taken along lines 5—5.

FIG. 6 is a side sectional view of a top portion of the wall panels showing the membrane attached to the top thereof prior to inflation and foaming.

DESCRIPTION OF THE PREFERRED EMBODIMENT

Figure 1:
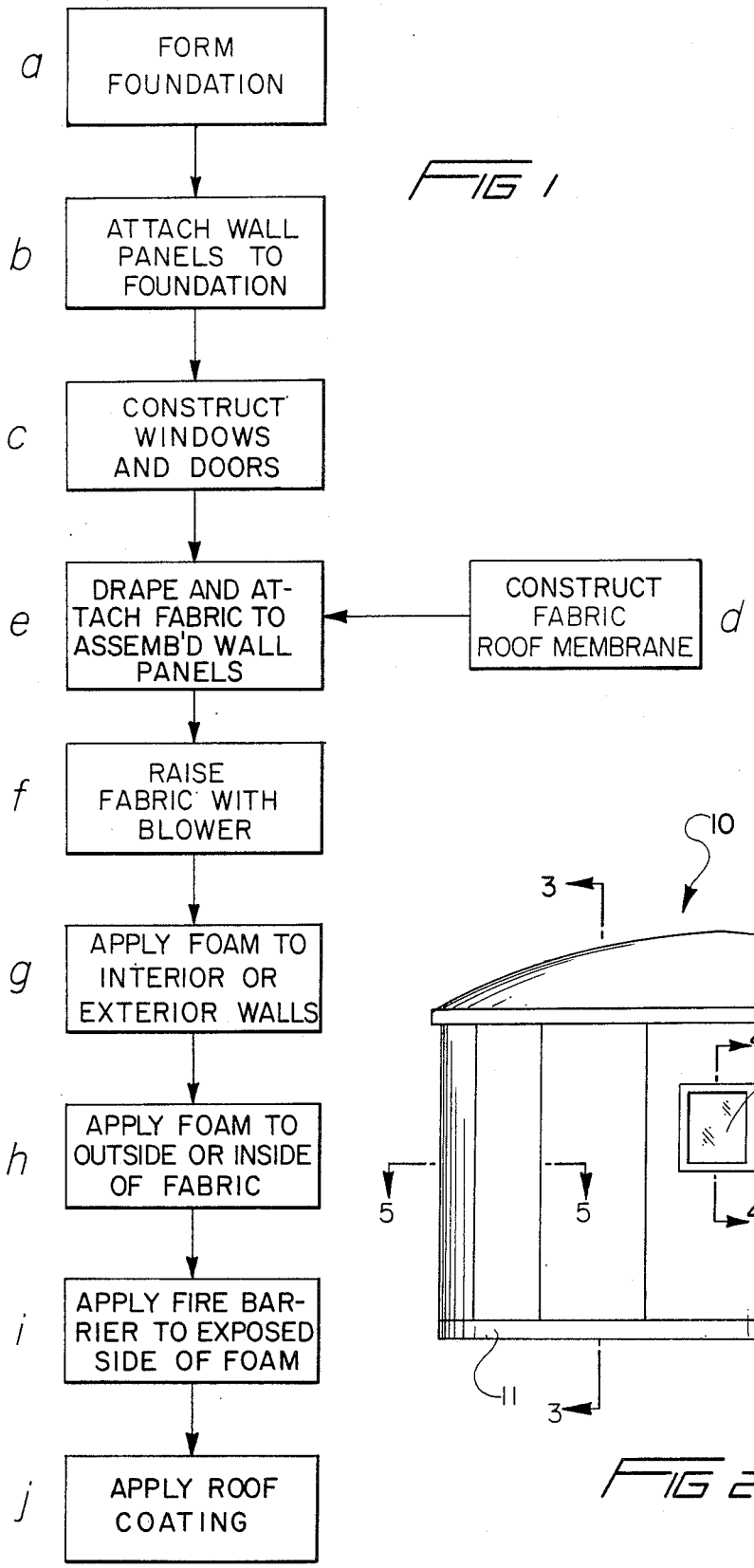
FIG. 1 is a flowchart depicting the various steps involved in the method associated with the instant invention.
Figure 2:
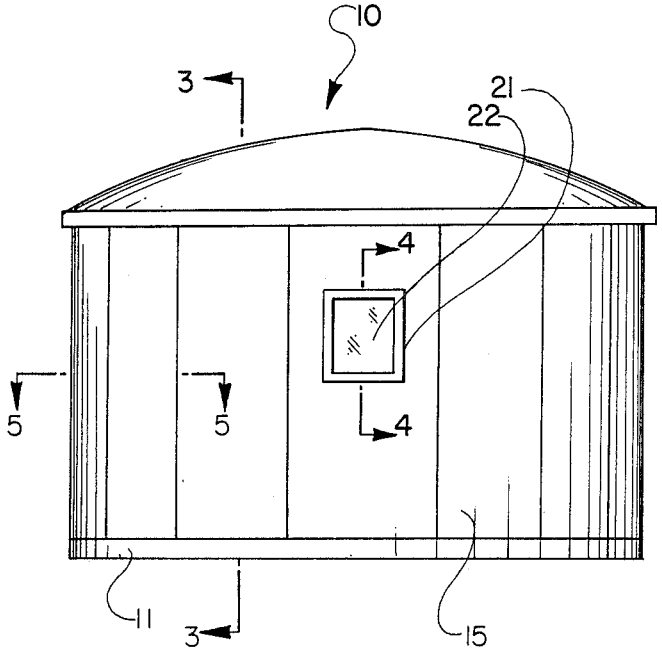
FIG. 2 is a side view of a simple structure fashioned according to the method of the invention.

Referring now to the drawings in detail wherein like reference numerals represent like parts throughout the several figures, reference numeral 10 refers generally to a structure formed according to the method of the instant invention.

The first step in the method, step (a) in the flowchart, involves pouring a foundation slab of concrete or the like upon which to erect a structure. As shown in FIG. 3, the foundation slab has on an outer peripheral edge a stepped portion 12 with a vertical baseboard 13 which was part of the form into which the concrete was poured. The baseboard 13 is left intact after the remainder of the concrete form is removed. The inner wall panels 14 and the outer wall panels 15 are attached to the baseboard 13 and the slab 11 by means of fasteners 16. The wall panels 14 and 15 may consist of sheets of plywood or any similar substance which can be readily flexed for conformational engagement with the peripheral edges of the slab 11 if the slab is nonrectalinear in configuration. By way of example only, a slab may be poured in a circular configuration such that two circles intersect, or are tangential, thereby requiring the wall panels 14 and 15 to conform to curved peripheral surfaces along the slab 11. Therefore, a material must be chosen for wall panels which is flexible enough to conform to various configurations yet provide the structural integrity to stand up alone.

As indicated by step (b), the wall panels 14 and 15 are attached to the slab somewhat above the stepped portion 12. One inner panel 14 is applied to the slab first, then an outer panel 15 is applied halflapping the inner panel such that adjacent edges 17 of inner panel 14 directly underlie an outer panel 15, as best shown in FIG. 5. This overlapping configuration of inner and outer panels is continued around the entire periphery of the slab 11 until a contiguous wall form is constructed. The outer panels 15 may be adhesively bonded to the inner panels 14 to ensure structural integrity and conformational engagement.

As indicated by step (c), after a contiguous wall panel form has been constructed, prefabricated doors and windows may be installed by cutting appropriately sized holes in the wall panels then installing windows 22, doors, or the like as shown in FIG. 4. After the desired windows and doors have been framed into the wall panels 14 and 15, then the electrical and plumbing conduits are applied accordingly to the interior surface of the inner wall panel. Similarly, any interior walls designed to carry electrical conduit may be framed out at this point or subsequent to inflating the roof membrane.

As indicated by step (d), a fabric membrane is constructed from any flexible but strong membrane material or fabric such as cloth, polyethelene or the like. The membrane 18 must be relatively impervious to air flow, or if it is not, it must receive a coating of a sealant to close any pores in the membrane. The membrane 18 need not be formed in any particular shape, as long as it is large enough to encompass the perimeter defined by the wall panels 14 and 15. If necessary, bolts of fabric may be sewn together to form a large sheet capable of encompassing the entire structure.

After a membrane of sufficient size is constructed, as indicated by step (d), then the membrane is draped over the entire structure such that middle portions of the membrane hang lower than peripheral portions of the membrane which will be attached to top of the wall panels 14 and 15. The shape and configuration of the membrane 18 is then adjusted, keeping in mind that when attached and inflated it will become the converse of the configuration observed in the draped mode. Thus the height and configuration of the ceiling to be formed is predetermined by adjusting the drape of the membrane 18 to a contour complemental to the shape desired to be made prior to inflation of same. As shown in FIG. 5, the membrane 18 may be attached to the upper edge of the outer wall panel 15 by means of a strip 19 which is attached to the upper peripheral edge of the outer wall panel 15 with the membrane 18 captured therebetween. Alternatively, the strip 19 may be placed on the interior panel 14 by placing the strip on the interior surface, as shown in phantom in FIG. 5.

After all the portals such as windows and doors are closed and sealed, an air blower is used to draw air from the outside of the structure to the inside of the structure, thereby creating a slight high pressure area within the structure which forces the membrane 18 to inflate and rise upwardly to the configuration desired. The strip 19 holds the membrane 18 in place and seals same along the entire upper periphery of the wall panels 14 and 15. After the membrane 18 has been raised by the blower, as indicated in step (f), the structure is ready for the application of a foam to either the interior or exterior wall and membrane surfaces.

It should be noted that the membrane 18 may also be supported by temporary structural members (not shown) in order to form roof shapes complemental with a desired configuration which is more readily achieved by suspending the membrane 18 rather than inflating it.

As indicated in step (g), a foam substance is then applied to the interior or exterior surfaces of the structure including the wall panels 14 and 15, but not the windows and doors, and the membrane 18 which forms a template upon which the foam is sprayed. The foam may be, but is not limited to, a polyurethane fire retardant foam which is sprayed onto desired surfaces. In one embodiment, the foam is sprayed onto the interior surfaces, the foam 20 adherring to the interior wall panels 14 and the interior of the membrane 18, as shown in FIGS. 3, 4, and 5. As shown in FIG. 4, the foam thus forms an interior wall 20 which is sprayed in sufficient thickness to approach the raised portion of the framing 21 of the window 22 which has been installed in the wall panels 14 and 15. Thus the foam forms a window casement around the window framing 21 while simsultaneously forming the interior wall surface 20. Typically, the foam components are sprayed together in a liquid form thereafter capturing gas in elemental bubbles and raising or increasing in thickness forming a rigid shell several inches thick. The foam spray is applied in layers until a desired thickness is reached.

In an alternate embodiment, the foam layer 20 may be applied to the exterior surfaces of the structure leaving the interior surfaces without foam. Similarly, a third embodiment contemplates applying the foam layer 20 to both the interior and exterior surfaces in a sandwich-type fashion with an optional structural reinforcement web 24 captured within the foam. In the first embodiment, the foam is applied to the interior surfaces thereby covering and hiding any electrical and/or plumbing conduits that have been applied to the interior surfaces of the structure, thereby eliminating the problems associated with cosmetic coverup at a later time. Thus as indicated by steps (g) and (h), the foam is applied to either the outside or the inside surfaces of the membrane 18 and wall panels 14 and 15. If the foam is applied to the outside of the panels 14 and 15, then the plumbing and electrical conduits are also installed on the outside so that the foam will cover them.

After the foam has had an opportunity to cure, a fire barrier 23 is applied to the exposed side of the foam layer 20. The fire barrier 23 may be a thin coat of conventional plaster or the like which forms an attractive textured interior wall surface which may thereafter be painted if desired. Similarly, plaster applied to the inner surface of the foam comprising the roof portion of the structure provides an attractive textured surface which may be painted or left as is. If the foam is applied to the outside of panels 14 and 15, then so is the plaster 23.

As indicated in step (j), a final coat of roof coating may be applied to the exterior foam surfaces in order to preserve same from the elements including rain and sun which may cause foam deterioration. Similarly, the exterior of the panels 14 and 15 may be finished with paint, plaster, shingles, etc., to present an attractive outer facade.

In order to control and gauge thickness to which the foam is applied a wire gauge (not shown) of a desired length may be pierced through the surface upon which the foam is to be sprayed thereby providing a visual gauge as to the progress of the foam spray. Thus a uniform thickness can be achieved by applying a number of wire gauges at various positions across the surfaces to be sprayed with the foam.

As an option, a stressing ring 25 may be installed with blocks 26 at an upper, outer edge of the outer panels 15 where the roof starts. The ring 25 serves to structurally reinforce the structure and provides an attractive facia board to trim the roof line.

It should be noted, that the foam provides not only an insulation value, but its primary function is that of a structural member integral to the structural integrity of the entire edifice. Once the foam has cured, it is the sustaining element that holds the entire structure together and becomes a hard shell capable of supporting loads comparable to those applied to structures utilizing typical rectalinear construction techniques. Furthermore, if the structure needs to be enlarged or enhanced this is easily accomplished by cutting away the foam in a desired area, creating another form adjacent thereto and applying a new coat of foam to the form using the techniques disclosed hereinabove.

It should be noted further that numerous structural modifications and changes are contemplated as available for use without departing from the spirit of the invention. For example, the rounded structure shown in FIG. 1 is depicted for the purpose of explanation and example only, and it is contemplated by applicant to form structures of any desired configuration including those with the appearance of normal rectalinear construction techniques.

I claim:

1. A building structure, comprising a foundation having a stepped portion, respective inner and outer upstanding panels forming a contiguous wall and having respective upper and lower portions, the lower portion of the respective panels being nested within the stepped portion of the foundation and secured thereto, the inner and outer panels overlapping one another so that the adjacent vertical edges of said inner panels underlie a respective outer panel, a membrane carried by the upper portion of the respective panels, and foam insulation applied to at least one of the interior and exterior surfaces of the membrane and panels.

2. The building structure of claim 1, wherein the foam insulation is applied to the interior surface of the membrane and panels.

3. The building structure of claim 2, further including a fire barrier applied to the foam insulation.

4. A building structure, comprising a foundation having a stepped portion, respective upstanding panels which are sufficiently flexible in a horizontal direction to conform to various building configurations, yet provide the structural integrity to stand up alone, said panels forming a contiguous wall and having respective upper and lower portions, the lower portions of the respective panels being nested within the stepped portion of the foundation and secured thereto, a membrane carried by the upper portion of the respective panels, and foam insulation applied to at least one of the interior and exterior surfaces of the membrane and panels, wherein the panels include inner and outer panels which overlap one another so that the adjacent vertical edges of said inner panels underlie an outer panel.

5. A building structure, comprising a foundation having a stepped portion, a plurality of respective inner and outer vertically upstanding panels in overlapping relationship to one another such that adjacent vertical edges of said inner panels abut one another and underlie an adjacent outer panel and forming a contiguous wall, the panels having respective upper and lower portions, means for securing the respective lower portions of the panels to the stepped portion of the foundation, a membrane having peripheral portions secured to the respective upper portions of the panels, foam insulation applied to the interior of the panels and said membrane, and a fire barrier applied to said foam insulation.

6. A building structure, comprising a foundation having a stepped portion, a plurality of respective inner and outer vertically upstanding panels in overlapping relationship to one another such that adjacent vertical edges of said inner panels abut one another and underlie an adjacent outer panel and forming a contiguous wall, the panels having respective upper and lower portions, means for securing the respective lower portions of the panels to the stepped portion of the foundation, a membrane having peripheral portions secured to the respective upper portions of the panels, foam insulation applied to the interior of the panels and said membrane, and a fire barrier applied to said foam insulation, wherein said panels are sufficiently flexible in a horizontal direction to conform to various building configurations, yet provide the structural integrity to stand up alone.

* * * * *